US010525484B2

(12) United States Patent
Ando et al.

(10) Patent No.: US 10,525,484 B2
(45) Date of Patent: Jan. 7, 2020

(54) DECANTER CENTRIFUGE HAVING A DILUTION SOLVENT SUPPLY UNIT AND METHOD FOR OPERATING A DECANTER CENTRIFUGE

(71) Applicant: TOMOE ENGINEERING CO., LTD., Shinagawa-ku, Tokyo (JP)

(72) Inventors: Katsuya Ando, Tokyo (JP); Mamoru Hasegawa, Tokyo (JP); Masahiro Ide, Tokyo (JP)

(73) Assignee: TOMOE ENGINEERING CO., LTD., Tokyo (JP)

( * ) Notice: Subject to any disclaimer, the term of this patent is extended or adjusted under 35 U.S.C. 154(b) by 451 days.

(21) Appl. No.: 15/504,545

(22) PCT Filed: Jul. 29, 2015

(86) PCT No.: PCT/JP2015/003827

§ 371 (c)(1),
(2) Date: Feb. 16, 2017

(87) PCT Pub. No.: WO2016/027420

PCT Pub. Date: Feb. 25, 2016

(65) Prior Publication Data

US 2017/0232453 A1 Aug. 17, 2017

(30) Foreign Application Priority Data

Aug. 20, 2014 (JP) ..... 2014-167887

(51) Int. Cl.
*B04B 15/06* (2006.01)
*B04B 1/20* (2006.01)
*B04B 15/12* (2006.01)

(52) U.S. Cl.
CPC ..... *B04B 15/06* (2013.01); *B04B 1/20* (2013.01); *B04B 15/12* (2013.01)

(58) Field of Classification Search
CPC ..... B04B 1/20; B04B 15/12; B04B 15/06
(Continued)

(56) References Cited

U.S. PATENT DOCUMENTS 3,423,015 A * 1/1969 O'Conor ..... B04B 1/20 494/27
4,496,340 A * 1/1985 Redeker ..... B04B 15/12 494/27
5,653,673 A * 8/1997 Desai ..... B04B 1/20 494/27

FOREIGN PATENT DOCUMENTS

GB 1 411 644 10/1975
JP 47-40556 12/1972
(Continued)

OTHER PUBLICATIONS

International Preliminary Report on Patentability with Written Opinion of the International Searching Authority dated Feb. 21, 2017 in corresponding International (PCT) Application No. PCT/JP2015/003827.

(Continued)

*Primary Examiner* — Walter D. Griffin
*Assistant Examiner* — Shuyi S. Liu
(74) *Attorney, Agent, or Firm* — Wenderoth, Lind & Ponack, L.L.P.

(57) ABSTRACT

A decanter centrifuge that carries out solid-liquid separation by centrifugal force on an object to be processed that is fed into a rotating bowl and designed from a solid and a saturated solution wherein that solid is dissolved, and discharges solid phase components from a solid discharge opening and discharges liquid phase components from a solvent discharge opening thereof by rotationally operating a screw conveyor disposed within the rotating bowl, the decanter centrifuge being provided with a dilution solvent supply unit for supplying, during centrifuging of the object
(Continued)

to be processed, dilution solvent that reduces the concentration of the saturated solution to a discharge path, which is a discharge path for saturated solution moving within the rotating bowl, and which is designed closer to the solvent discharge opening side-than a chamber for supplying the object to be processed.

7 Claims, 2 Drawing Sheets

(58) Field of Classification Search
USPC ..... 494/27
See application file for complete search history.

(56) References Cited

FOREIGN PATENT DOCUMENTS

| | | |
|---|---|---|
| JP | 3-147794 | 6/1991 |
| JP | 2000-350946 | 12/2000 |
| JP | 2002-18320 | 1/2002 |
| JP | 2002-502300 | 1/2002 |
| JP | 2013-662 | 1/2013 |

OTHER PUBLICATIONS

International Search Report dated Oct. 27, 2015 in International Application No. PCT/JP2015/003827.

* cited by examiner

DECANTER CENTRIFUGE HAVING A DILUTION SOLVENT SUPPLY UNIT AND METHOD FOR OPERATING A DECANTER CENTRIFUGE

TECHNICAL FIELD

The present invention relates to a decanter centrifuge that carries out solid-liquid separation by centrifugal force on an object to be processed that is designed from a solid and a saturated solution in which the solid is dissolved, etc.

BACKGROUND ART

In the food field, for example, processing has been performed in which a saturated solution containing dissolved solids such as food residues is cooled to produce an object to be processed in a solid-liquid mixture state, which is designed from a saturated solution and solids, and solid-liquid separation is carried out on the object to be processed with a decanter centrifuge.

The decanter centrifuge includes: a rotating bowl provided with a solvent discharge opening on one end side in the direction of its rotation axis and a solid discharge opening on the other end side thereof; and a screw conveyor disposed within the rotating bowl. The decanter centrifuge is configured to carry out solid-liquid separation by the centrifugal force of the rotationally operating rotating bowl on the object to be processed and to collect the solids from the solid discharge opening and discharge separated liquid from the solvent discharge opening with the screw conveyor.

CITATION LIST

Patent Literature

Patent Literature 1: JP47-40556
Patent Literature 2: JP2013-662

SUMMARY OF INVENTION

Technical Problem

The present inventor has found out a problem in which the solids are precipitated from the centrifuged saturated solution and the precipitated solids obstruct the solvent discharge opening. As one method for eliminating such obstruction, a method of temporarily stopping the operation of the decanter and removing the solids adhering to the solvent discharge opening by washing is conceivable In order to carry out this method, however, the washing needs to toe performed after the large decanter rotating at high speed is decelerated and stopped. Additionally, no object to be processed can be fed unless the decanter is accelerated to a predetermined speed (for example, 4000 rpm) after the washing. In other words, the decanter needs to stop the centrifuge processing during the decelerating, washing, and accelerating periods of the decanter, thus impeding the efficient processing.

From another perspective, a method of heating a centrifuged saturated solution to obtain an unsaturated solution is also conceivable. The saturated solution becomes more soluble by being heated, thus suppressing the precipitation of the solids. According to this method, however, a rapidly rotating large decanter having high heat capacity needs to be heated. Thus, its practicability is low.

Here, a method for suppressing the precipitation of the solids by adding a dilution solvent that reduces the concentration of the saturated solution to the decanter together with the object to be processed is also conceivable. However, the solids having undergone the solid-liquid separation may be dissolved by the dilution solvent, thus lowering the recovery rate of the solids.

In view of this, it is an object of the present invention to prevent the obstruction of a solvent discharge opening by solids precipitated from a saturated solution without lowering the recovery rate of solids while continuing operation of a centrifuge.

Solution to Problem

A centrifuge of the present invention is (1) a decanter centrifuge including a rotating bowl and a screw conveyor disposed within the rotating bowl. The decanter centrifuge carries out solid-liquid separation by centrifugal force on an object to be processed that is fed into the rotating bowl from a chamber for supplying the object to be processed, that is designed within the screw conveyor and designed from a solid and a saturated solution in which the solid is dissolved, and discharges a solid phase component from a solid discharge opening designed on one end side in an axial direction of the rotating bowl and discharges a liquid phase component from a solvent discharge opening designed on the other end side thereof by rotationally operating the screw conveyor. The decanter centrifuge includes a dilution solvent supply unit supplying, during centrifuging of the object to be processed, a dilution solvent, which reduces a concentration of the saturated solution, to a discharge path for the saturated solution moving within the rotating bowl toward the solvent discharge opening. The discharge path is designed closer to a side of the solvent discharge opening in the axial direction than the chamber for supplying the object to be processed.

(2) In the configuration of (1) described above, the dilution solvent supply unit may spray the dilution solvent to the solvent discharge opening. According to the configuration of (2), the dilution solvent is directly sprayed to the solvent discharge opening where the solid is precipitated. Consequently, the obstruction of the solvent discharge opening can be more effectively prevented from occurring.

(3) In the configuration of (2) described above, the dilution solvent supply unit may be provided with a solvent spraying opening at a position closer to a rotation axis of the rotating bowl than the solvent discharge opening. According to the configuration of (3), there is no need to spray the solvent while resisting the centrifugal force of the rotating bowl. Thus, the injection pressure of the dilution solvent can be reduced.

(4) In any one of the configurations (1) to (3) described above, the dilution solvent supply unit may include a pipeline extending along the screw conveyor, and the pipeline may be connected to a dilution solvent supply chamber designed within the screw conveyor.

A method for operating a centrifuge according to the present invention is (5) a method for operating a decanter centrifuge, the decanter centrifuge including a rotating bowl and a screw conveyor disposed within the rotating bowl, wherein the decanter centrifuge is configured to carry out solid-liquid separation by centrifugal force on an object to foe processed that is fed into the rotating bowl from a chamber for supplying the object to be processed that is designed within the screw conveyor and designed from a solid and a saturated solution in which the solid is dissolved, and to discharge a solid phase component from a solid discharge opening designed on one end side in an axial direction of the rotating bowl and discharge a liquid phase component from a solvent discharge opening designed on the other end side thereof by rotationally operating the screw conveyor. The method for operating the decanter centrifuge includes supplying, during centrifuging of the object to be processed, a dilution solvent, which reduces a concentration of the saturated solution, to a discharge path for the saturated solution moving within the rotating bowl toward the solvent discharge opening. The discharge path is designed closer to a side of the solvent discharge opening in the axial direction than the chamber for supplying the object to be processed.

Advantageous Effects of Invention

According to the present invention, supplying the dilution solvent to the discharge path for the saturated solution moving toward the solvent discharge opening can prevent the obstruction of the solvent discharge opening by the solids precipitated from the saturated solution. Moreover, since the process of supplying the dilution solvent is performed during the operation of the centrifuge, the processing efficiency of the centrifuge is prevented from degrading. Furthermore, since the dilution solvent is supplied only to the discharge path for the saturated solution, the centrifuged solids can be prevented from being dissolved in the dilution solvent to lower the recovery rate of the solids.

DESCRIPTION OF EMBODIMENTS

Figure 1:
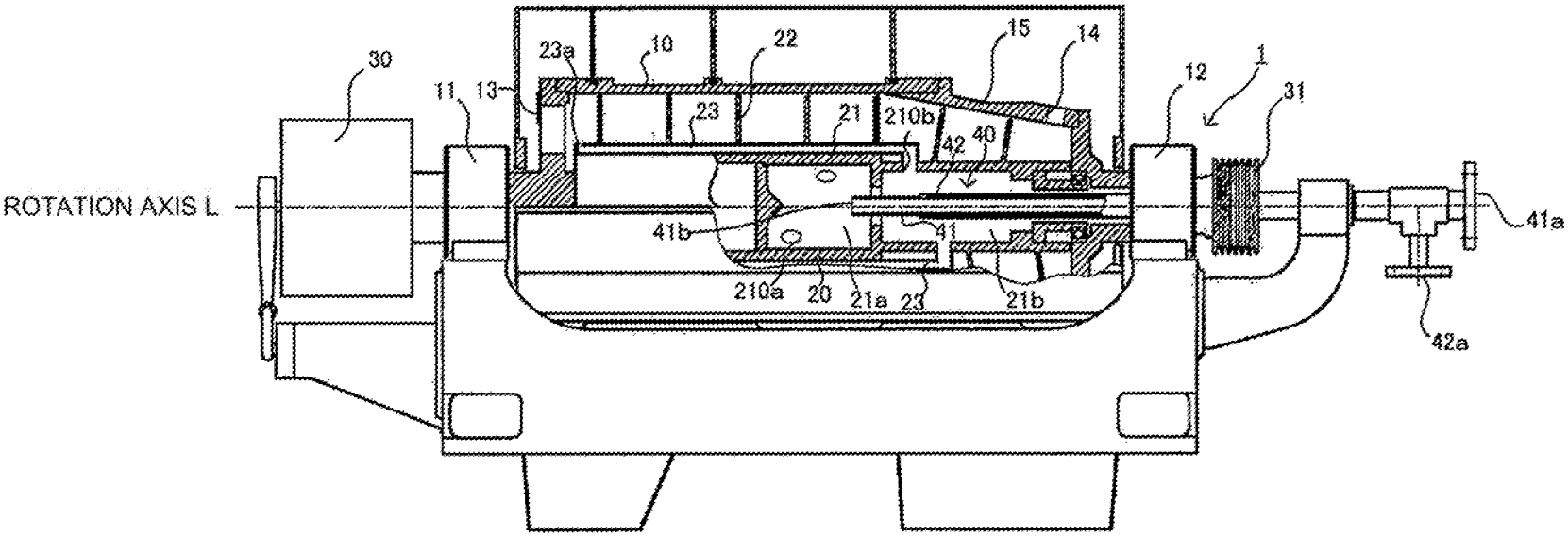
FIG. 1 is a diagram illustrating an overall configuration of a decanter according to an embodiment of the present invention.
Figure 2:
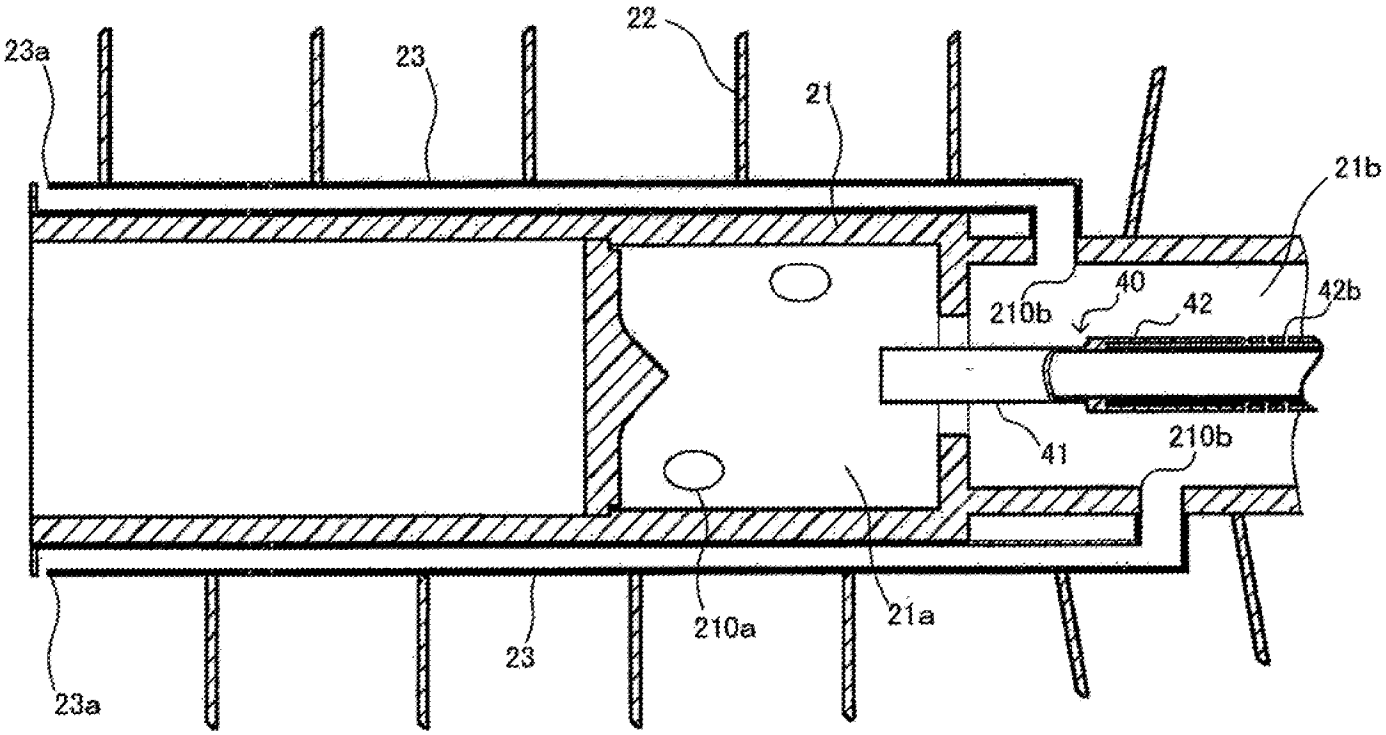
FIG. 2 is an enlarged view illustrating part of the decanter.

Hereinafter, a centrifuge according to a preferred embodiment of the present invention will be described taking a horizontal decanter as an example. Note however that embodiments, which will be described below, are not to be construed as limiting the technical scope of the present invention. FIG. 1 is a front view of the decanter and a cross-sectional view illustrating part thereof. FIG. 2 is an enlarged view illustrating elements shown in the cross-sectional view.

With reference to these figures, the decanter 1 includes a rotating bowl 10 and a screw conveyor 20 disposed within the rotating bowl 10. The rotating bowl 10 rotates about a rotation axis L indicated by a chain doable-dashed line. One end of the rotating bowl 10 in the direction of the rotation axis L is rotatably supported by a bearing 11, whereas the other end thereof is rotatably supported by a bearing 12. A plurality of solvent discharge openings 13 are designed on the one end side of the rotating bowl 10 in the direction of the rotation axis. These solvent discharge openings 13 are arranged around the rotation axis L of the rotating bowl 10. Intervals between adjacent ones of the solvent discharge openings 13 are set at approximately equal distances. The opening shape of the solvent discharge opening 13 may be circular, for example.

A plurality of solid discharge openings 14 are designed in the other end of the rotating bowl 10 in the direction of the rotation axis L. These solid discharge openings 14 are arranged around the rotation axis L of the rotating bowl 10. Intervals between adjacent ones of the solid discharge openings 14 are set at approximately equal distances. The opening shape of the solid discharge opening 14 may be circular, for example.

A beach part 15 inclined toward the solid discharge openings 14 in the direction of the rotation axis L is designed on an inner wall surface on the other end side of the rotating bowl 10 in the direction of the rotation axis L. Note, however, that the present invention can be applied also to a rotating bowl 10 having no beach part 15 and thus having a fixed inner diameter.

The screw conveyor 20 has the function of conveying solids to which centrifugal force is applied in the rotating bowl 10. The screw conveyor 20 rotates with a differential speed rate relative to the rotating bowl 10. In other words, the screw conveyor 20 rotates at a rotational speed slower than that of the rotating bowl 10 by the transmission of power from a gearbox 30. A planet gear, for example, may be employed in the gearbox 30.

A screw blade 22 is spirally designed on the outer peripheral surface of a barrel 21 of the screw conveyor 20. A hollow (buffer part) is designed with in the barrel 21. The hollow includes a chamber 21*a* for supplying an object to be processed and a solvent supply chamber 21*b* for supplying a dilution solvent to a centrifuged saturated solution. A plurality of passages 210*a* for the object to be processed are designed on the outer peripheral surface of the chamber 21*a* for supplying the object to be processed.

A supply pipe 40 extends in the direction of the rotation axis L of the rotating bowl 10 through a pulley 31 for driving the rotating bowl 10. The supply pipe 40 is configured to have a double pipe structure including a main supply pipe 41 and a secondary supply pipe 42 designed on the outer periphery of the main supply pipe 41. One end of the main supply pipe 41 forms an opening 41*a* for introducing the object to be processed at the outer side of the rotating bowl 10. The other end of the main supply pipe 41 forms an opening 41*b* for supplying the object to be processed inside the chamber 21*a* for supplying the object to be processed.

The object to be processed, which has been introduced from the opening 41*a* for introducing the object to be processed, is introduced into the chamber 21*a* for supplying the object to be processed via the main supply pipe 41. A saturated solution containing solids is used as the object to be processed. Such solids are obtained, for example, as a result of precipitation by the cooling of the saturated solution or as those remaining undissolved in the saturated solution. In other words, the object to be processed by the decanter 1 of the present embodiment is a solution in a solid-liquid mixture state in which solids are precipitated by the cooling of a saturated solution. Examples of the saturated solution may include a saturated solution in which monosodium glutamate is dissolved, a saturated solution in which food residues are dissolved, and a saturated solution used in the field of chemicals. Examples of the saturated solution used in the field of chemicals may include solutions containing ammonium sulfate, salts such as sodium chloride, and amino acids.

One end of the secondary supply pipe 42 forms a dilution solvent introduction opening 42*a* at the outer side of the rotating bowl 10, whereas the other end of the secondary supply pipe 42 is closed. The provision of the secondary supply pipe 42 results in the formation of an annular dilution solvent passage along the outer periphery of the main supply pipe 41. A plurality of dilution solvent supply openings 42*b* are designed in a region of the secondary supply pipe 42 extending along the rotation axis L. These dilution solvent supply openings 42*b* are in communication with the solvent supply chamber 21*b*.

A plurality of openings 210*b* are provided in the circumference of the solvent supply chamber 21*b*. One ends of dilution solvent passage pipes 23 are connected to these opening 210*b*. Consequently, the dilution solvent passage pipes 23 rotate together with the screw conveyor 20. Note that the number of the dilution solvent passage pipes 23 equals the number of the openings 210*b*.

The dilution solvent passage pipe 23 extends along the direction of the rotation axis of the screw conveyor 20. A solvent spraying opening 23*a* is designed at a termination of the dilution solvent passage pipe 23. The solvent spraying opening 23*a* is provided at a position closer to the solvent discharge opening 13 than at least the chamber 21*a* for supplying the object to be processed. In other words, the solvent spraying opening 23*a* is designed at an appropriate position capable of spraying the dilution solvent to a solution discharge path of the saturated solution having undergone the solid-liquid separation by centrifugation. The solution discharge path refers to a region within the rotating bowl and outside the screw conveyor 20 and closer to the solvent discharge openings 13 than the chamber 21*a* for supplying the object to be processed in the direction of tine rotation axis L of the rotating bowl 10 (note, however, that a region at which the solvent discharge openings 13 are positioned is also included). The solvent supply chamber 21*b*, the dilution solvent passage pipes 23, and the secondary supply pipe 42 work together to constitute a dilution solvent supply unit.

The saturated solution is diluted by supplying the dilution solvent to the aforementioned solution discharge path, thereby suppressing the precipitation of the solids. This can prevent the solvent discharge opening 13 from being obstructed by the precipitated solids. If the precipitated solids obstruct the solvent discharge opening 13, the precipitated solids can be dissolved by bringing them into contact with the unsaturated solution diluted by the dilution solvent. This can eliminate the obstruction of the solvent discharge opening 13. As just described, the obstruction of the solvent discharge opening 13 can be prevented from occurring by making the precipitation of the solids less likely to occur or by dissolving the precipitated solids according to the present embodiment.

Moreover, the dilution solvent is supplied only to a solvent discharge path of the solvent discharge path and a solid discharge path adjacent to each other in the direction of the rotation axis L of the rotating bowl 10. Thus, the centrifuged solids can be recovered without being in contact with the dilution solvent. In other words, the centrifuged solids can be prevented from being dissolved in the dilution solvent and thus being unrecoverable as solids.

More specifically, the solvent spraying opening 23*a* is designed at a position for spraying the solvent toward the solvent discharge opening 13 in the case of the present embodiment. This allows for the direct spraying of the dilution solvent toward the solvent discharge opening 13 at which the solids are more likely to precipitate. Consequently, the obstruction in the solvent discharge opening 13 can be more reliably prevented from occurring.

Preferably, the solvent spraying opening 23*a* is disposed in a region closer to the rotation axis L of the rotating bowl 10 than the solvent discharge opening 13, i.e., on a radially more central side of the rotating bowl 10. If the solvent spraying opening 23*a* is disposed closer to the radially outer side of the rotating bowl than the solvent discharge opening 13, such a configuration needs to spray the dilution solvent to the solvent discharge opening 13 while resisting the centrifugal force of the dilution solvent passage pipe 23 rotating together with the screw conveyor 20. Thus, when the injection pressure of the dilution solvent is small, the dilution solvent cannot be allowed to reach the solvent discharge opening 13.

Disposing the solvent spraying opening 23*a* at a position closer to the rotation axis L of the rotating bowl 10 than the solvent discharge opening 13 eliminates the need to spray the dilution solvent while resisting the centrifugal force. Thus, the dilution solvent can be sprayed to the solvent discharge opening 13 with a smaller injection pressure. An appropriate solvent capable of diluting a saturated solution to obtain an unsaturated solution can be used as the dilution solvent. Water or acetone, for example, may be employed as the dilution solvent.

Operations of the decanter 1 will be described next. First, the rotating bowl 10 and the screw conveyor 20 are caused to rotate at predetermined speeds. When the rotational speeds of the rotating bowl 10 and the screw conveyor 20 reach predetermined speeds, respectively, the object to be processed is fed into the main supply pipe 41 via the opening 41*a* for introducing the object to be processed. The fed object to be processed is supplied to the chamber 21*a* for supplying the object to be processed from the opening 41*b* for supplying the object to be processed in the main supply pipe 41. The object to be processed is then supplied into the rotating bowl 10 from the passages 210*a* for the object to be processed in the chamber 21*a* for supplying the object to be processed.

The centrifugal force by the rotating bowl 10 is applied to the object to be processed, which has been supplied into the rotating bowl 10. Consequently, the object to be processed accumulates over the whole circumference of a pool part of the rotating bowl 10, and the solids settle out by difference in specific gravity on the inner peripheral surface side of the rotating bowl 10. The settled solids on the inner peripheral surface side of the rotating bowl 10 are transferred toward the beach part 15 by the screw blade 22 of the rotationally operating screw conveyor 20. The solids are separated from the saturated solution by reaching the beach part 15. The solids separated from the saturated solution ascend the beach part 15 to be discharged to the outside of the rotating bowl 10 through the solid discharge openings 14.

The saturated solution, on the other hand, overflows from the solvent discharge openings 13 when the object to be processed is continuously supplied. At this time, if processing for the object to be processed further continues, the solids precipitated from the saturated solution adhere to the solvent discharge openings 13. Hence, according to the present embodiment, a process of spraying the dilution solvent to the solvent discharge openings 13 is performed at appropriate timing after the feeding of the object to be processed is started. More specifically, the process of spraying the dilution solvent toward the solvent discharge openings 13 via the secondary supply pipe 42, the solvent supply chamber 21*b*, and the dilution solvent passage pipes 23 is performed after the elapse of a predetermined period of time since the start of the feeding of the object to be processed. The sprayed dilution solvent dissolves the solids, thus preventing the obstruction of the solvent discharge opening 13.

While the dilution solvent is sprayed after the elapse of the predetermined period of time since the start of the feeding of the object to be processed in the present embodiment, the present invention is not limited thereto. For example, a method of spraying the dilution solvent at the same time as the start of the feeding of the object to be processed may be employed. The spraying method may be carried out continuously or intermittently.

The invention has been described in detail according to a specific embodiment, but it will be apparent to those having ordinary skill in the art that various substitutions, modifications, and changes in its form and details are possible without departing from the spirit and scope of the invention as defined by the scope of claims. Thus, the scope of the invention should be determined on the basis of the scope of claims and their equivalents, rather than being limited to the above-described embodiment and the accompanying drawings.

The invention claimed is:

1. A decanter centrifuge comprising: a rotating bowl; and a screw conveyor disposed within the rotating bowl, the decanter centrifuge being configured to carry out solid-liquid separation by centrifugal force on an object to be processed that is fed into the rotating bowl from a chamber for supplying the object to be processed that is designed within the screw conveyor, and to discharge a solid phase component from a solid discharge opening designed on one end side in an axial direction of the rotating bowl and discharge a liquid phase component from a solvent discharge opening designed on the other end side thereof by rotationally operating the screw conveyor, wherein the object to be processed is designed from a solid and a saturated solution in which the solid is dissolved, the decanter centrifuge comprises a dilution solvent supply unit for supplying, during centrifuging of the object to be processed, a dilution solvent, which reduces a concentration of the saturated solution, to a discharge path for the saturated solution moving within the rotating bowl toward the solvent discharge opening, with the discharge path designed closer to a side of the solvent discharge opening in the axial direction than the chamber for supplying the object to be processed, the dilution solvent supply unit is provided with a solvent spraying opening at a position closer to the solvent discharge opening in the axial direction than an end of a screw blade of the screw conveyor on the solvent discharge opening.

2. The decanter centrifuge according to claim 1, wherein the dilution solvent supply unit sprays the dilution solvent to the solvent discharge opening.

3. The decanter centrifuge according to claim 2, wherein the solvent spraying opening is provided at a position closer to a rotation axis of the rotating bowl than the solvent discharge opening.

4. The decanter centrifuge according to claim 1, wherein the dilution solvent supply unit includes a pipeline extending along the screw conveyor, and the pipeline is connected to a dilution solvent supply chamber designed within the screw conveyor.

5. A method for operating a decanter centrifuge, the decanter centrifuge including a rotating bowl and a screw conveyor disposed within the rotating bowl, wherein the decanter centrifuge is configured to carry out solid-liquid separation by centrifugal force on an object to be processed that is fed into the rotating bowl from a chamber for supplying the object to be processed that is designed within the screw conveyor, and to discharge a solid phase component from a solid discharge opening designed on one end side in an axial direction of the rotating bowl and discharge a liquid phase component from a solvent discharge opening designed on the other end side thereof by rotationally operating the screw conveyor, the object to be processed is designed from a solid and a saturated solution in which the solid is dissolved, the method for operating the decanter centrifuge comprising spraying, during centrifuging of the object to be processed, a dilution solvent, which reduces a concentration of the saturated solution, to a discharge path for the saturated solution moving within the rotating bowl toward the solvent discharge opening, with the discharge path designed closer to a side of the solvent discharge opening in the axial direction than the chamber for supplying the object to be processed, a dilution solvent spraying opening is provided at a position closer to the solvent discharge opening in the axial direction than an end of a screw blade of the screw conveyor on the solvent discharge opening.

6. The decanter centrifuge according to claim 2, wherein the dilution solvent supply unit includes a pipeline extending along the screw conveyor, and the pipeline is connected to a dilution solvent supply chamber designed within the screw conveyor.

7. The decanter centrifuge according to claim 3, wherein the dilution solvent supply unit includes a pipeline extending along the screw conveyor, and the pipeline is connected to a dilution solvent supply chamber designed within the screw conveyor.

* * * * *